US005829941A

United States Patent [19]

Zamorano Morfin

[11] Patent Number: 5,829,941

[45] Date of Patent: Nov. 3, 1998

[54] RADIAL MECHANIZED GARAGE PARKING SYSTEM

[76] Inventor: Luis Rodolfo Zamorano Morfin, Cacatuas No. 53, Fraccionamiento Lomas de Las Aguilas, C.P. 01730, Mexico

[21] Appl. No.: 771,235

[22] Filed: Dec. 20, 1996

Related U.S. Application Data

[63] Continuation-in-part of Ser. No. 174,691, Dec. 22, 1993, abandoned.

[30] Foreign Application Priority Data

| | | | |
|---|---|---|---|
| Dec. 23, 1992 | [MX] | Mexico | 927515 |
| Oct. 4, 1993 | [MX] | Mexico | 936173 |
| Dec. 7, 1993 | [MX] | Mexico | 937724 |

[51] Int. Cl.[6] ..... E04H 6/00

[52] U.S. Cl. ..... 414/261; 414/254; 414/252; 414/231

[58] Field of Search ..... 364/478.02, 478.03; 414/261, 262, 263, 252, 227, 231, 232, 234, 242, 243, 249, 264, 254, 273; 187/253; 52/30, 31, 29

[56] References Cited

U.S. PATENT DOCUMENTS

| | | | |
|---|---|---|---|
| 1,966,165 | 7/1934 | Clyde . | |
| 3,439,815 | 4/1969 | Wagner | 414/263 X |
| 3,497,087 | 2/1970 | Vita . | |
| 4,594,044 | 6/1986 | Soot | 414/263 |
| 4,971,505 | 11/1990 | Sawyer | 414/261 X |
| 4,976,580 | 12/1990 | Krakirk | 414/263 |
| 5,281,069 | 1/1994 | Tsujimoto | 414/231 |

FOREIGN PATENT DOCUMENTS

| | | |
|---|---|---|
| 194563 | 4/1957 | Australia . |
| 623859 | 3/1927 | France . |
| 1275082 | 11/1961 | France . |
| 2075378 | 10/1971 | France . |
| 1759653 | 6/1971 | Germany . |
| 1759691 | 11/1971 | Germany . |
| 161573 | 6/1992 | Japan . |
| 500361 | 1/1971 | Switzerland . |
| 408386 | 9/1996 | Switzerland . |
| 1012579 | 12/1965 | United Kingdom . |

*Primary Examiner*—Frank E. Werner
*Attorney, Agent, or Firm*—Ladas & Parry

[57] ABSTRACT

The present invention refers to improvements provided by a robotized, radial type parking system, allowing twelve vehicles to be parked per floor without the need of areas for vehicle maneuvering or circulation, and which can be used in any urban area, especially where the land is scarce and expensive; the result is a high level of efficiency and density for vehicle parking as compared with the overall land and building area.

14 Claims, 10 Drawing Sheets

RADIAL MECHANIZED GARAGE PARKING SYSTEM

This application is a continuation-in-part of application Ser. No. 08/174,691 filed on Dec. 22, 1993, now abandoned.

BACKGROUND OF THE INVENTION

1. Field of the Invention

The present invention refers to improvements provided by a robotized, radial type parking system, allowing twelve vehicles to be parked per floor without the need of areas for vehicle maneuvering or circulation, and which can be used in any urban area, especially where the land is scarce and expensive; the result is a high level of efficiency and density for vehicle parking as compared with the overall land and building area. A parking lot of this type is described in the Mexican patent application No. 927515, owned by the present applicant and in the U.S. counterpart application Ser. No. 08/174,691, now abandoned, from which this application is a Continuation-in-Part.

2. Prior Art

There are sundry presently-existing parking systems and they can be classified in as non-mechanized, mechanized and robotized. The non-mechanized systems provide ease of circulation to allow vehicles to move from the entrance to the parking space, whether located on a single ground-level floor, or on a higher floor where access is obtained by means of sloping ramps, or where the parking spaces form part of such sloping ramp. This parking system is characterized by low efficiency, high investment costs, the need for a large parcel of land and construction area, and low operating and maintenance costs. The second type of parking lots (mechanized) is characterized by a higher level of efficiency, ranging from those with a low level of sophistication combining an elevator mechanism with circulation lanes, to fully mechanized systems where the vehicles are suspended in the lifting equipment itself or in vertically-placed niches and finally the robotized system, in which the cars are parked by totally autonomous and automatic mechanisms without any operator intervening. Use of the latter system has been extremely restricted and for to very specific applications, due to their high investment cost.

From the foregoing, there appears a need for designing and building parking systems which combine the following factors of primary importance:

a) An efficient use of urban land
b) Vertical construction, to allow greater parking capacity
c) The requirement for land of reduced dimensions
d) Low investment cost
e) Low operating cost
f) High efficiency in connection with the area needed for parking a car vs. the overall construction area
g) Reliability
h) Low maintenance
i) Low live weight vs. dead weight ratio of the parking system
j) Easy operation
k) Modular construction
l) A capacity which can be expanded
m) Recovery of investment plus operating costs
n) Highly mechanized
o) Automated.

In the radial robotized parking system the foregoing design factors are taken into consideration, providing potential benefits in technical and economic aspects.

SUMMARY OF THE INVENTION

An object of the present invention is to provide parking for cars in a robotized, radial-type system, which is efficient, novel, functional and extremely economical for installation in urban areas.

Another object of the present invention is to optimize the use of urban land areas by parking vehicles on two or more floors. Another object of the present invention is to eliminate car circulation, ascent and descent ramps and lanes, in order to better utilize the available construction area of the parking building.

An additional object of the present invention is to have a car-lifting system which, once vehicles are lifted from one level to another, revolves on its own axis to allow the vehicles to be placed at a suitable ascent and descent angle axis.

Another object of this invention is to provide a parking system wherein the dead weight of the building is relatively low when compared with the live weight of the cars and their occupants, in order to reduce the investment costs.

Yet another object of this invention is to provide a robotized and automated system to work faster in placing the cars, and which operates with a high degree of security for the vehicles and the parking system itself Finally, an object of the present invention is to provide a modular parking system the capacity of which can be increased in accordance with the needs of each specific case, and which is easily made, put together and operated. The foregoing objects are realized by a new parking system of the radial, robotized type, mainly consisting of a foundation slab of reinforced concrete, which will serve as a supporting platform for the structure of the building, as well as, serving as the main floor of the parking system; a metallic or concrete structure with radial girders sustained by suitably-distributed columns for supporting both the dead weight of the building and the live weight of the cars; a revolving elevator of purely hydraulic type or of hydraulic type with cables type in the center of each tower which, in addition to hoisting the vehicles, revolves back and forth around a central axis to acquire any of twelve preselected positions within 330°, a signaling and control system which allows the control system to identify available or unoccupied spaces and make the elevator booth stop vertically on the desired floor and horizontally in the required position, while at the same time allowing safe operation of the elevator in order to prevent any translation or rotation while a vehicle is being lifted or lowered to the elevator booth. More specifically, the parking system of the present invention comprises a cylindrically-shaped building of two or more floors in the form of a circular crown, placed one above the other in perfect alignment, in such a way that its structural elements coincide when seen from above. The floors are supported by columns in a way that each floor has the capacity to house twelve radially-placed cars.

The car elevator is placed in the center of the circular crown of each floor, which will raise or lower the vehicles to each floor or from each floor to the main level and will position them by revolving on its central axis, in the ascent or descent to the required angle of the elevator, according to the relative position of the parking space or point of exit. A feature of this elevator is that, in addition to its translation movement, it also rotates the structural guide tower, the car lift and the hydraulic liking system. The elevator consists of a vertical revolving structure which turns on its vertical longitudinal axis and which, in its lower part, serves as a support for the hydraulic lifting equipment and as a guide for the lifting booth which runs vertically within the guide bars of the structure itself. The metallic structure consists basically of a revolving table in the form of an inverted pyramid which supports two structural legs throughout the vertical run of the entire elevator and the hydraulic equipment, and whose upper extremity is another pyramid. Two central (an upper rotational supports and a lower one placed at the vertexes of the pyramids) formed by ball bearings, define the revolving axis of the structure, the booth and the hydraulic equipment and the rotation is obtained by the action of an operator on the lower part of the table which through a crown gear, a pinion and electrical gear motors, starts the rotary movement which will permit the radial positioning of the elevator booth in each of the twelve parking places corresponding to each of the floors. The elevator booth is equipped with a robot for placing the cars into or removing them from the booth, by totally synchronized mechanisms.

At the entrance of the parking system there is located a car centering device, which serves to locate the cars in alignment within the entrance and allows proper operation of the robot.

The elevator is activated by an oleohydraulic system equipped with hydraulic pistons and pumps so that, when the pistons move outside the cylinders, the elevator booth is raised, and vice versa. The elevator is also equipped with electrical and electronic controls to allow its loading and unloading operation, turn clockwise and counterclockwise, and controls to prevent its translation and rotating movements if the robot and the vehicles are not in a safe position.

The parking system will be equipped with a complete indication and control system, which automatically operates to position the elevator, position the robot, indicate of vacant spaces, access, raising and rotation of the elevator, and elevator call The indication and control system basically consists of two logical control programmers, a control panel which governs the elevator, obstruction sensors, positioning sensors and proximity sensors. The system as a whole will have a specially-designed operating language and software for exercising the desired actions in accordance with the specific configuration of the equipments.

The characteristic aspects of the present invention will become clearer and easier to understand as the new parking system is described, making use of the attached drawings for this object.

DETAILED DESCRIPTION OF THE INVENTION

Multiple parking systems can be classified by their features as non-mechanized, mechanized and robotized. The first ones can consist of one or several floors where the vehicles circulate by a central horizontal, or sloping ascending lane, with parking spaces at the sides in battery form. Their efficiency is low (under 35%) because the cars require extensive space for circulation and allow relatively large turning radii for parking in battery form. The second mechanized parking systems, have evolved in some of the industrialized nations and usually include elevator systems or mechanical vehicle locators and the third type have had a scarce development due to the great complexity of their systems and components, as well as the high cost of investment; but with the current technical advances have a promising future.

The system disclosed herein, falls within the robotized type. This type of parking system can be installed in any urban location having sufficient ground space for installing in a modular way, one or several towers of two floors or more, as needed. In order to explain better and clearly the new parking system, the following description has been divided into chapters, each of which is referred to a fundamental part of the parking system.

Parking Building

The parking building, consists of a vertical structure, of either reinforced concrete or, preferably metallic members, which is usually cylindrical in form with several floors, which can be from two to an indefinite number, in accordance with the special conditions of each case. In the central part of the foundation of the building there is a cylindrical well in which the elevator tower is grounded and which also can be made of concrete.

The building structure can be supported by a foundation, depending on the specific conditions of the project, the height of the building, the overall weight, the soil conditions, etc. These foundations can take the form of an extended slab of reinforced concrete (1), isolated shoes or continuous foundations in the form of concentric circular rings.

Figure 1:
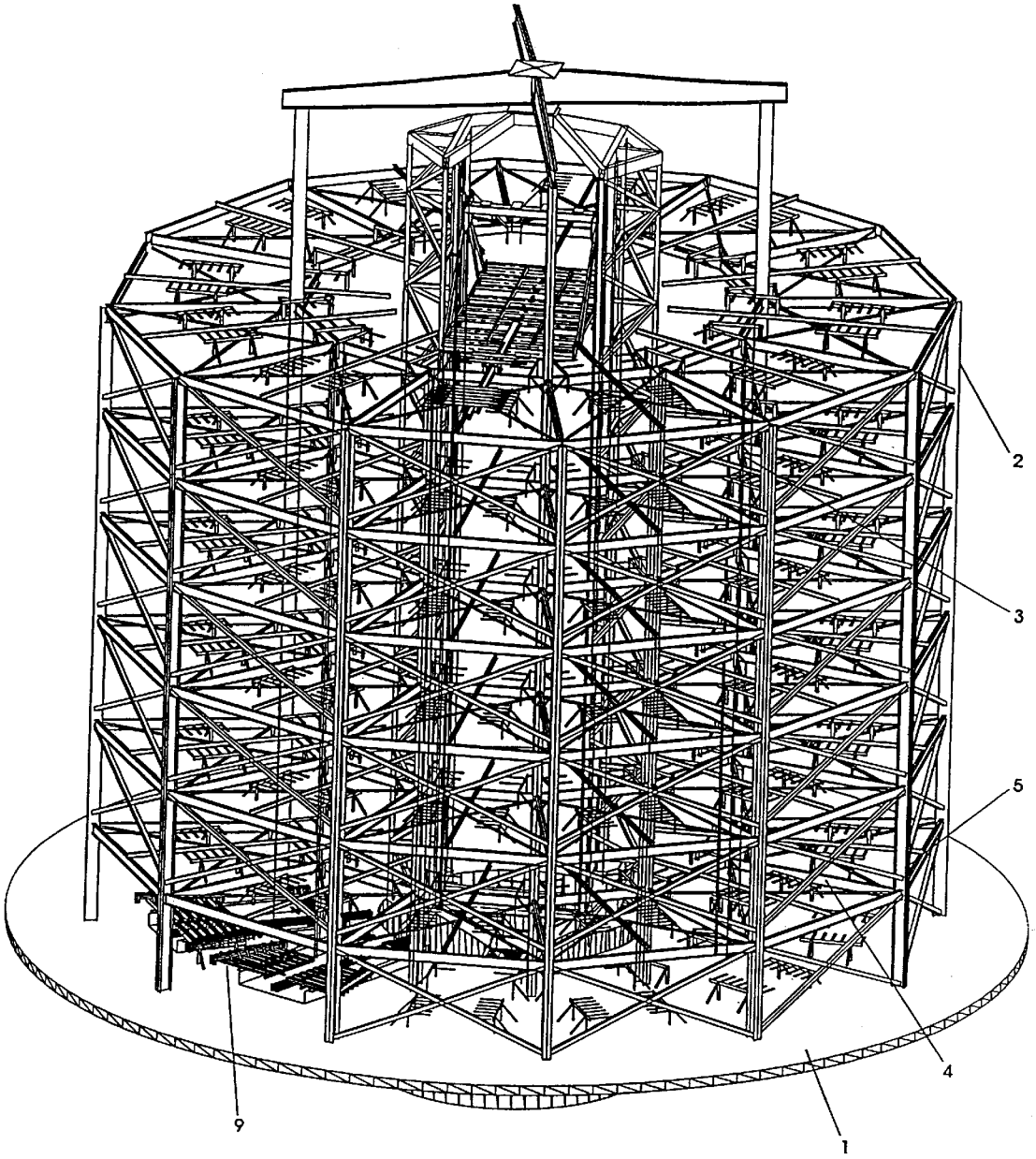
FIG. 1 shows an isometric view of the parking garage in accordance with its embodiment as a seven story building with its principal equipment.
Figure 2:
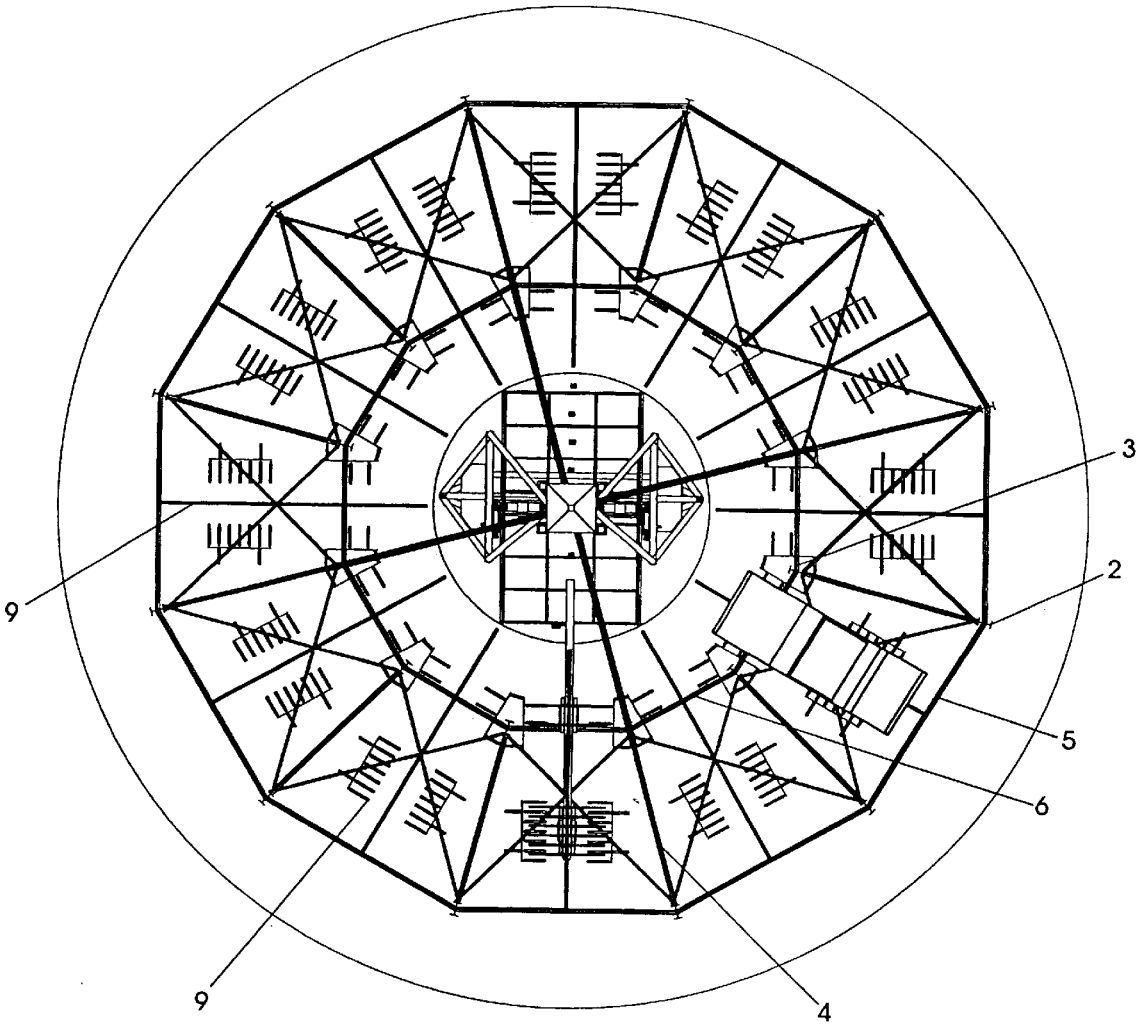
FIG. 2 shows an upper floor of the parking building, indicating the radial distribution of the parking spaces.
Figure 3:
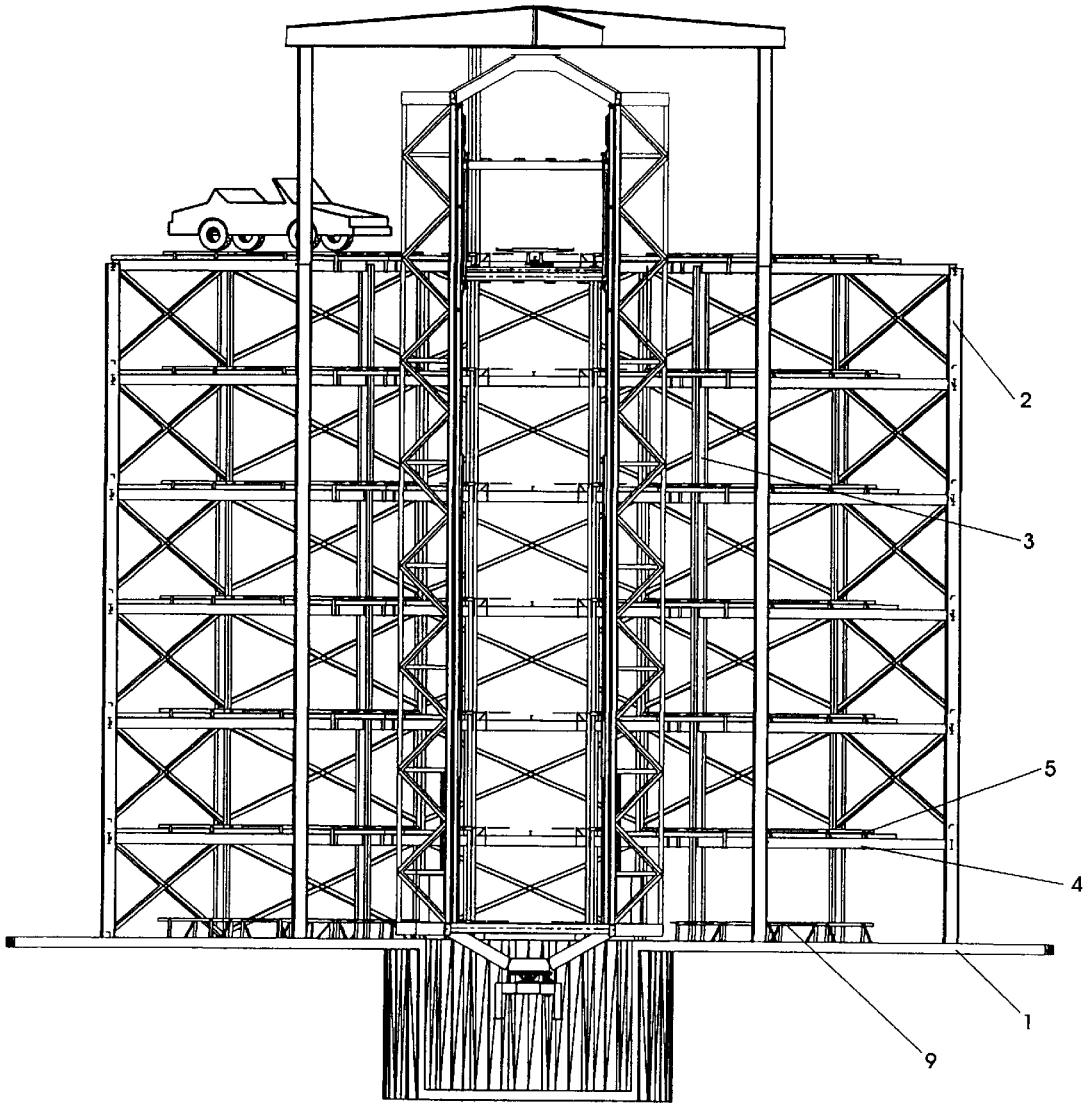
FIG. 3 is a vertical cross sectional view of the parking building, showing the different floors, the car elevator and the robot.

External columns (2) are placed on the foundation slab, and internal columns (3) are supported on the first floor and hold the primary girders (4), which are placed in radial form, and circular external girders (5) and internal circular girders (6). All the internal circular girders (6) shown in FIG. 3, are joined in a circular ring or a structural dodecagon which limits the central space where the car elevator (10) travels. There can be provided radial braces to resist seismic forces.

Except for the main floor, the building in each one of the levels has no proper floor, but the cars are held merely by special trays provided in each parking place. Additionally, there can be shielding sheeting to prevent dust and oil from the car above from falling on the car below; likewise, it can have a metal sheeting runner to be used for maintenance or inspection purposes, with access ladders.

Equipment

The equipment basically comprises four elements, each covering several components of a system. The first element is the car elevator (10), FIGS. 2, 3, 4 and 5, the second is the elevator tower rotation system (7), the third is the car robot (8) and the fourth is the car centering device (9).

Mechanical Equipment for Car Lifting and Positioning

The car elevator (10), as the name indicates, is intended to lift or lower vehicles to each of the operating levels and place them in the precise loading and unloading angle, complementing the effects of translation and rotation required for car placement, and reducing maneuvers to a minimum.

Figure 4:
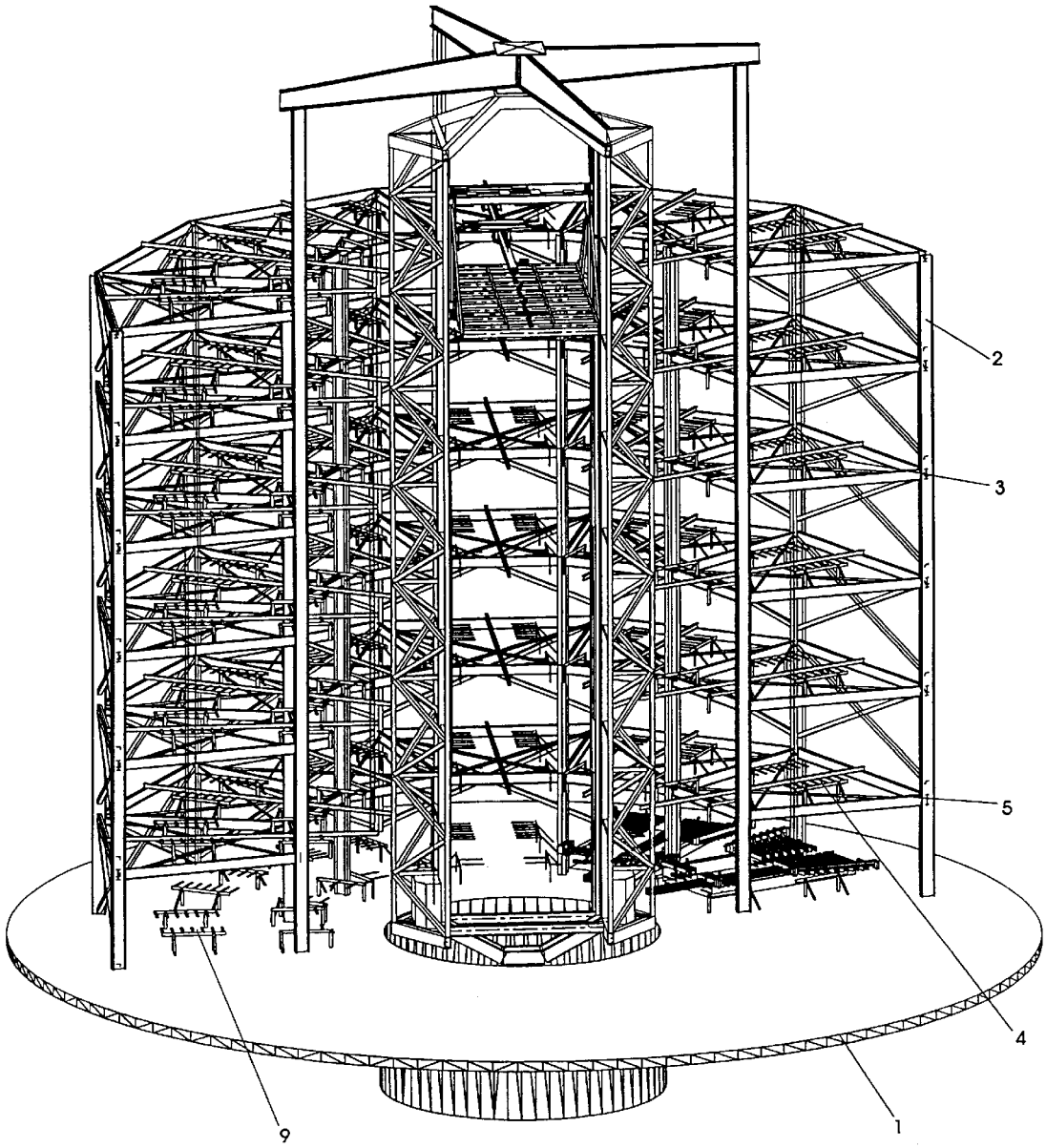
FIG. 4 is a cross sectional view from a 30° angle, seen from the back, showing the car elevator.
Figure 5:
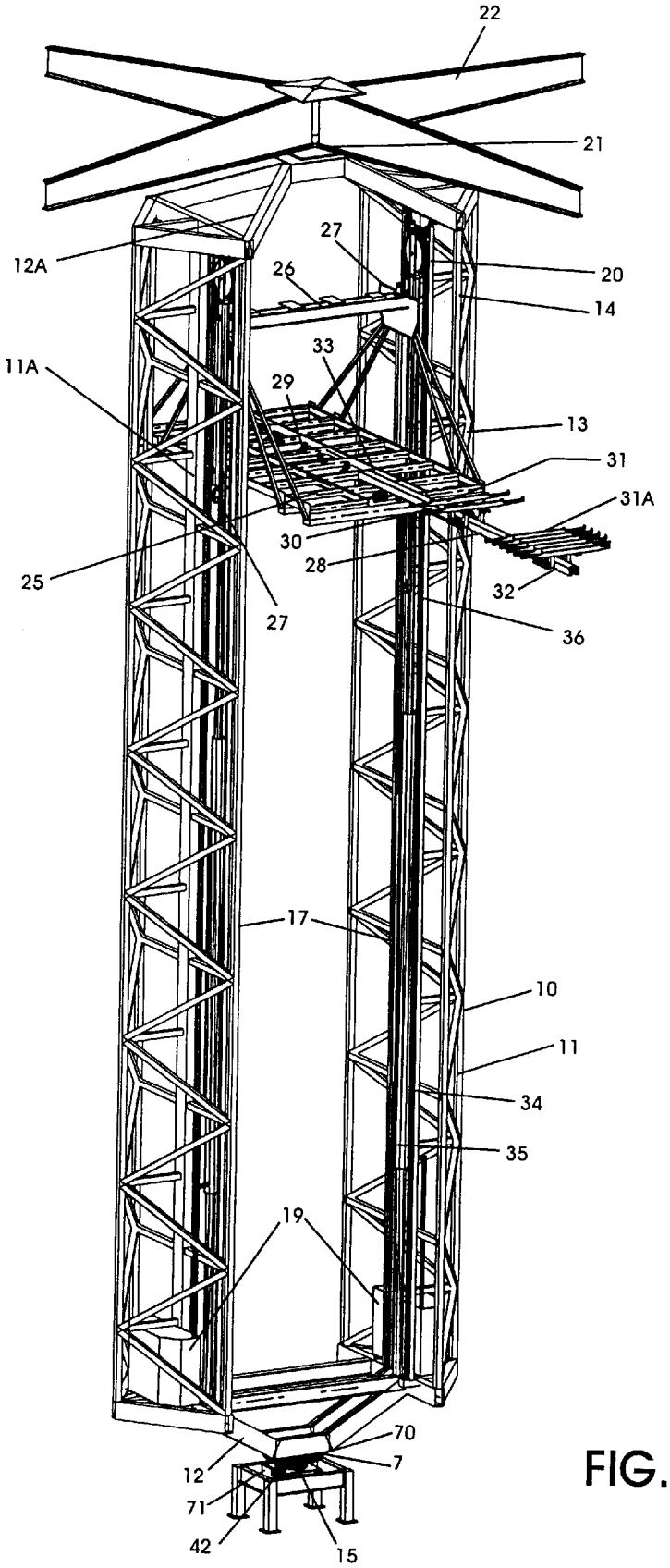
FIG. 5 is a complete view of the car elevator including the robot.
Figure 6:
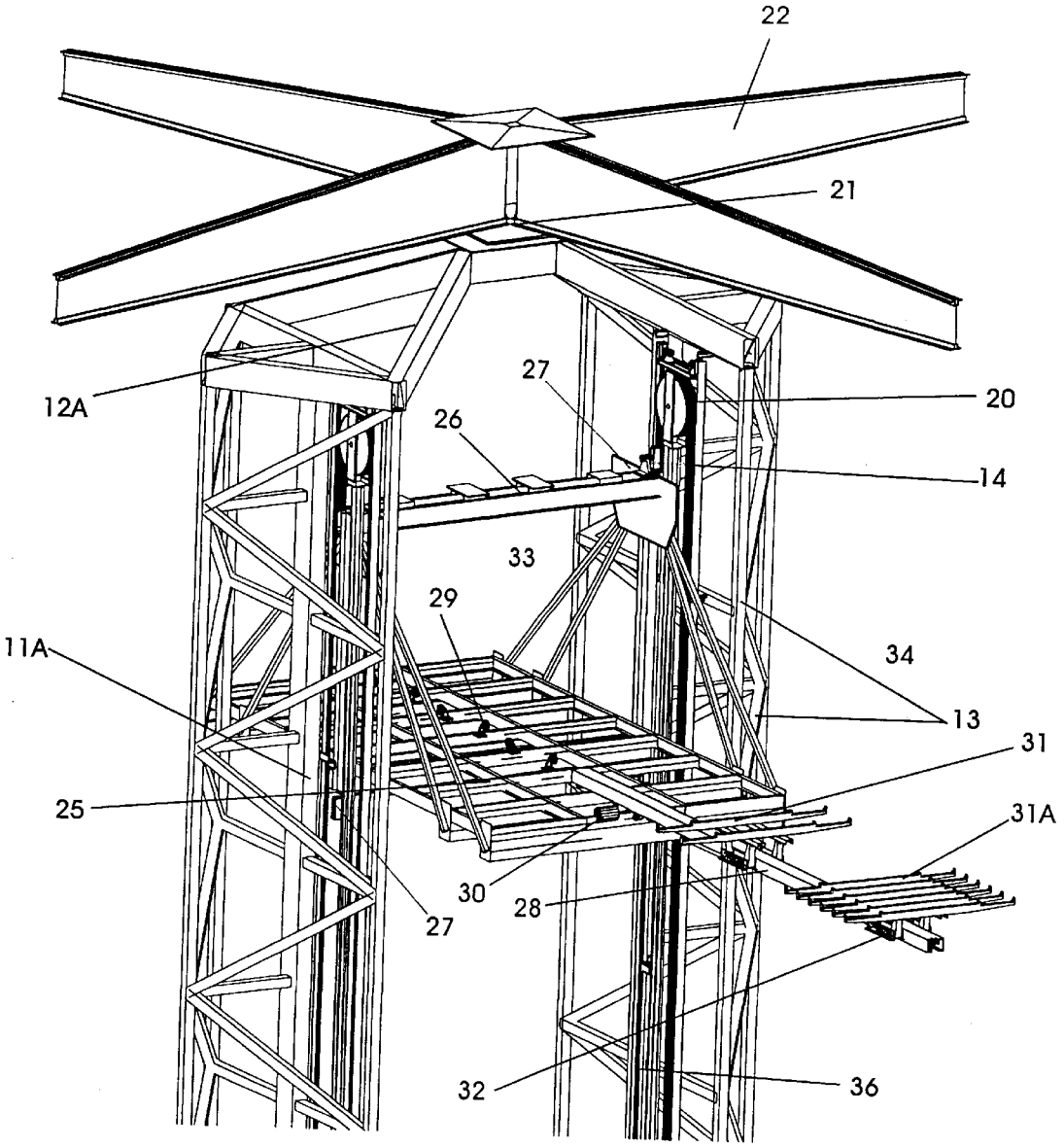
FIG. 6 shows details of the elevator booth, including protection and signaling equipment.
Figure 7:
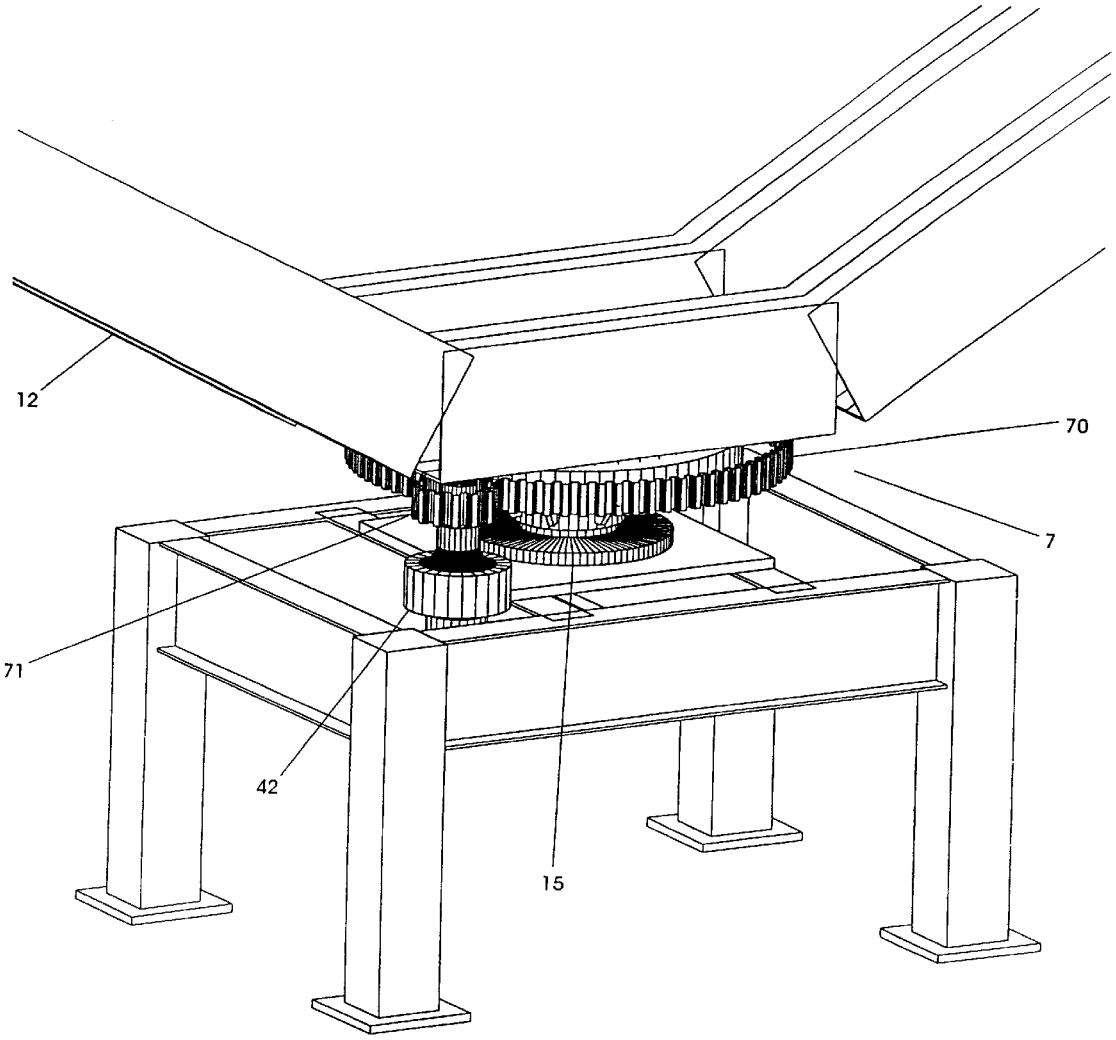
FIG. 7 is an isometric view of the lower section or base of the car elevator.

The car elevator comprises a supporting, rotating and guiding structure (11) in the form of a tower, as shown in FIGS. 4, 5 and 6. The elevator tower includes by two structured metallic columns and the tower is supported only at the top and the bottom thereof. The columns are vertical parallel and serve as a guide for the elevator booth (25). The lower part of the tower structure (11) ends in a kind of inverted pyramid (12), whose lower end acts as a rotating support for the entire tower, including the elevator booth and hydraulic equipment, utilizing an axial type bearing (15) which is firmly attached to the foundation on one side, and on the other side to the lower inverted structured pyramid (12) of the elevator. On its upper part the structure of the elevator also ends in a kind of structural pyramid (12*a*). A transverse element join the two metallic columns of tower (11) guiding the elevator; at the center or vertex of pyramid 12*a* is another bearing (21), but in this case, for resisting radial loads, which is joined in the lower part to the elevator tower (10), and at the upper part is joined to four horizontal girders (22) forming a cross which in turn, are attached to four internal columns (3) of the parking building, in order to keep the vertical rotating shaft of the elevator itself centered and properly aligned. The two metallic columns are composed of primary elements (11*a*), which form a vertebral column thereof with secondary elements (13), which increase their rigidity, mainly when it is necessary to install many floors. The primary structural elements (11*a*), located vertically serve as for installing vertical parallel rails (17), which will guide the ascent or descent of the elevator booth (25). The secondary elements (13), aside from providing additional rigidity to the primary elements, allow the secondary guiding rails (14) to be stiffened for the upper pulleys (20) of the pistons (36) of the elevator's hydraulic system, avoiding in this way any possible misalignment in the vertical piston stroke on leaving or entering the cylinders (35).

The structural lower part of the elevator is also intended to house the rotation system consisting of a crown gear (70), driven by a pinion gear (71) which itself is driven by a vertical gear motor (42) located on the elevator support structure within the elevator well.

The operation of the gear motor will make the elevator as a whole (metallic structure, booth, hydraulic system, etc.) turn around the vertical axis driven by the bearing of the gear motor located tangentially relative to the gear crown. The driving element comprises an electric motor receiving precise signals from the control system, to adopt a preselected position by the logic programmable controller's master control, in clockwise or counterclockwise direction, allowing the booth to rotate between the booth's original position and its final destination position.

The oleohydraulic equipment of the elevator, is basically constituted by the following essential elements: One or two hydraulic power units (19) to store and return hydraulic oil from the system; one or two hydraulic pumps (not shown in the drawings) located inside the oleohydraulic tanks in a submerged type arrangement and driven by one or two electric motors (not shown) which, on functioning, inject the hydraulic oil through control valves (not shown) towards the lower part of the hydraulic cylinders (35) placed on each side of the booth (25), and running parallel to the metallic structure (11) and the guide rail (17). Two grooved pulleys (20) are placed on the upper ends of the cylinders (36), said pulleys supporting the elevator cables (34), and being fastened at one end to the structural base (12) of the revolving tower (11) and, at the other end, to the frame of the elevator booth (25). The electric actuation of the hydraulic pump motors results in the oil from the storage tanks being injected at high pressure at the base of the hydraulic cylinders (35), which results in the pistons being vertically displaced upwards, so that the metallic cables fastened to the elevator booth are displaced in one direction so that the booth itself rises with a run equal to twice the stroke of the hydraulic pistons. When the hydraulic control valves mounted on the hydraulic power units let the oil housed in the cylinders to be drained, the pistons will retract under the weight of the booth and the load and will transfer the oil to the storage tanks, driving the metallic cables in the opposite direction, making the elevator booth slide downwardly.

The elevator booth (25), consists of a platform of metallic sheeting in parallelepiped form, suitably reinforced by structural elements (26) constituting a frame, to allow it to be hoisted from the transversal ends, preventing their permanent deformation. Guides (27) are placed on the upper and lower edges of the booth, which can be of the sliding shoe type or revolving bearing type, which engage the guide rails (17) on three sides, allowing the booth to move vertically, perfectly guided state, thus achieving the desired alignment of the booth (25) throughout its vertical travel. On top of the elevator booth there is located a car robot (8), which serves to take the vehicles parked in the centering device (9), to introduce them into the elevator booth which will transport them from their start position to their final position in the parking building and to thereafter deposit the cars in each of the parking places of the building. The robot comprises a central tubular beam (28) which is grooved in its lower part and housing inside a series of bearing wheels (29) that allow the beam to be moved outwardly from the booth, in a little less than its total length. The displacement of this beam, is effected by means of an engine (30) which can be hydraulic, electric or of any other nature; this displacement movement is totally reversible. On top of the sliding beam there (28) are located two sets of comb-shaped transverse metallic bars (31) and (31*a*) for raising the cars by their wheels upon raising the bars, by means of hydraulic pistons (32) or electric engines to remove the cars; or lower the cars by means of the reverse action of the mechanisms to leave the vehicles positioned. There are only two transverse bars (31) for holding the front wheels of the cars, and they are separated a suitable distance to allow the wheels to be trapped between them; the transverse bars (31*a*) for holding the rear wheels of the cars can be in varying amounts so that any size of car can be raised by one or two of them, independently of their distance to the wheel axis or the width of the vehicle. In the case that the functioning of the robot is hydraulic, both for the sliding of the moving beam as well as vertically moving the transverse beam mechanism, the hydraulic oil will be pressure pumped by means of a hydraulic pump located within another hydraulic power unit positioned in the elevator booth. The signals to actuate the robot come from the Logical Programmable Controller, installed in the elevator booth.

The means of vertically moving the booth is of the traditional type for hydraulic elevators and comprises one or two of the hydraulic power units (19), equipped with electric engine rotary pumps and an electrically operated control valve system, two of said hydraulic pistons (36) located at both sides of thee booth and which of their upper part carry the grooved traction pulleys (20) for the metallic cables (34) held at one end to the structural rotary bottom of the elevator (12) and at the other end to the reinforcement frame (26) of the booth of the elevator itself by means of the necessary fixation hardware. The system further includes the guide rails (17) for the booth, the guide rails (14) for the hydraulic pistons and security systems such as shock absorbers (18).

In the upper part of the rotary table (12) there are located two of such spring shock absorbers (18) having the purpose to progressively reduce the impact of a sudden descent of the elevator booth.

At the entrance level of the parking building, which can be the main floor, the top floor or any intermediate floors, access places will be located for the vehicles entering the parking building. In order for the elevator robot to take the vehicles in a fixed and predetermined position, one or several centering devices will be installed, for locating the vehicles within the entrance, in the right alignment to ensure that the robot takes the vehicles in an effective fashion. The centering device comprises two combs or beds of metallic rollers (60) (one at the right and one at the left) on which the car will be parked by the drivers for further alignment. These rollers (61) have the feature of allowing under certain conditions the side displacement of the cars within a certain range. The roller beds (60), are provided with a braking system thereof to preclude their rotation when the cars are parked thereon; afterwards the brakes will be released when activating the car centering mechanism.

Figure 8:
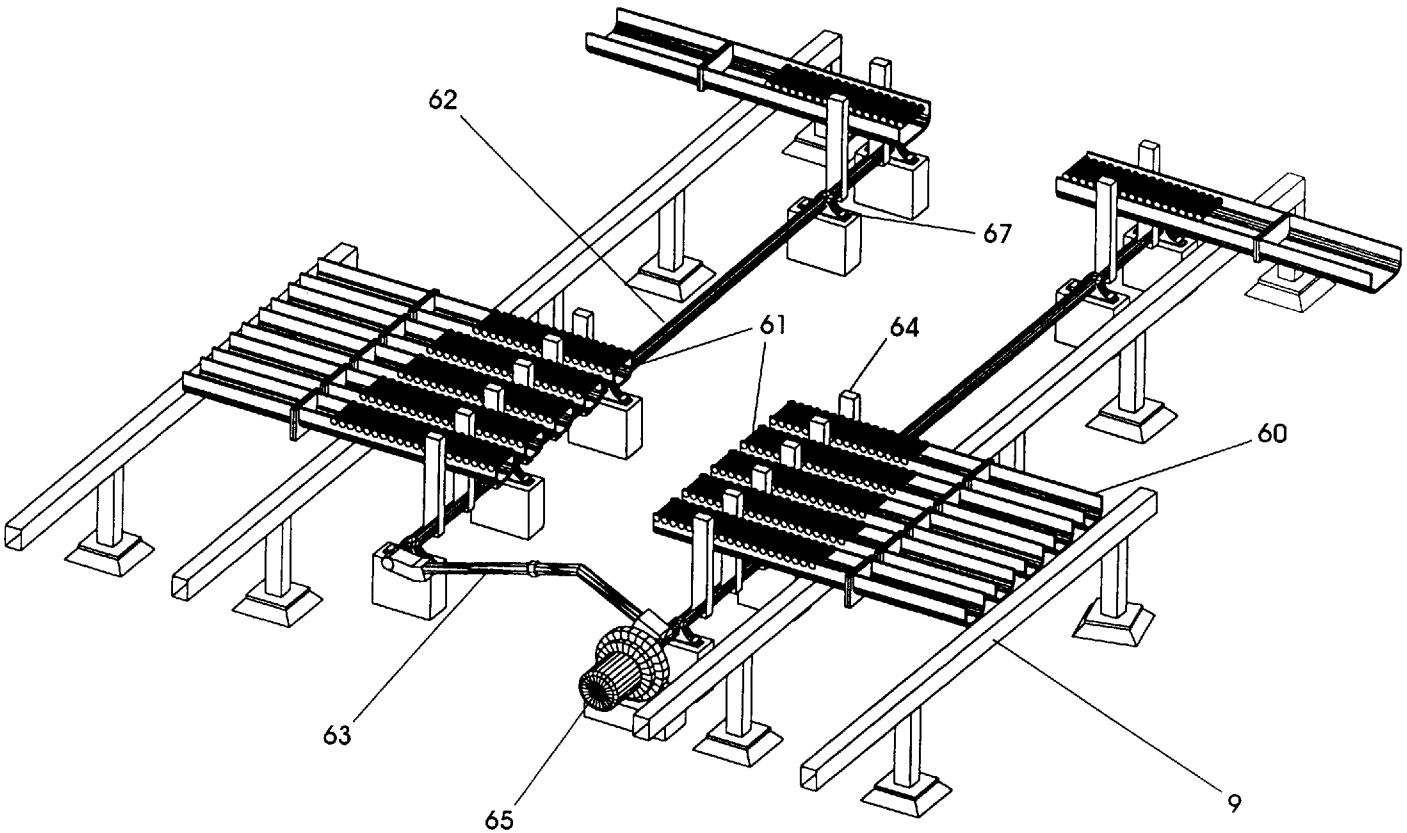
FIG. 8 shows the car centering device in an isometric view.
Figure 9:
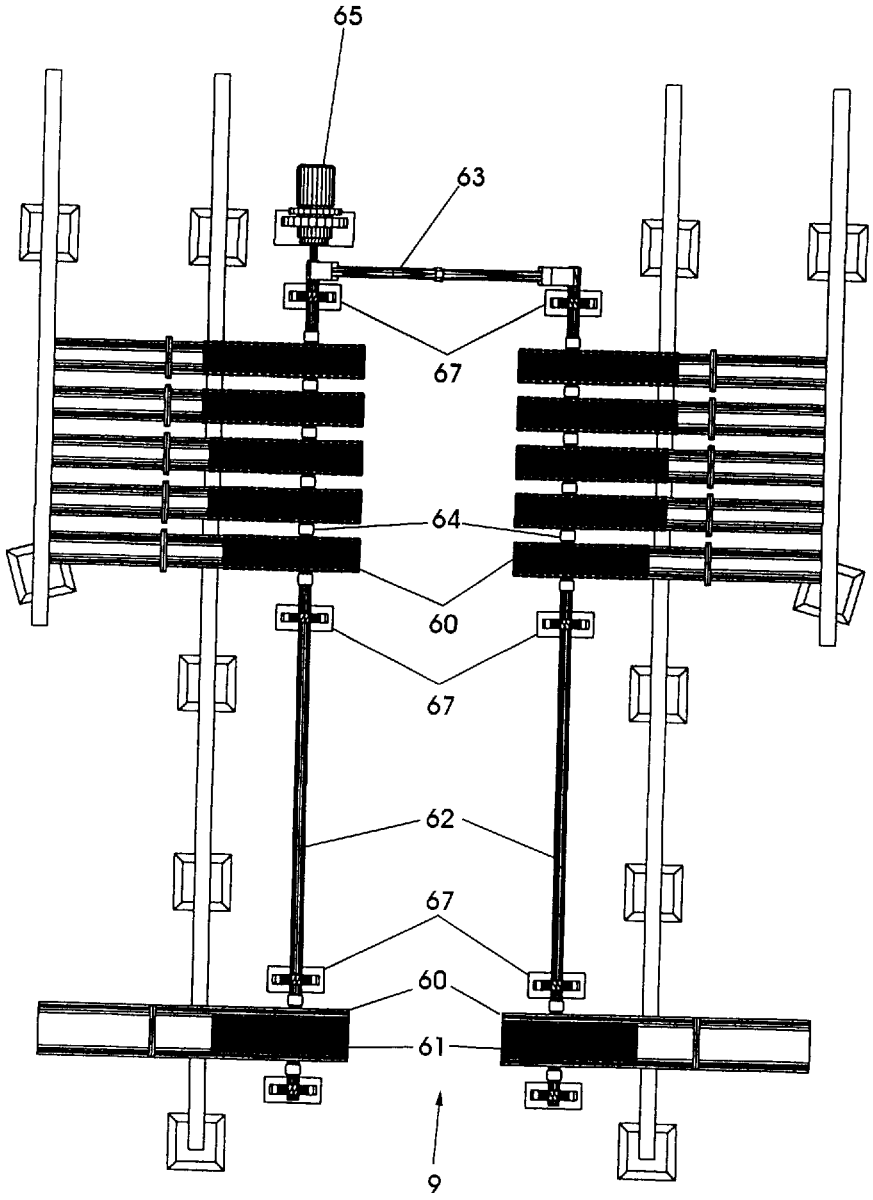
FIG. 9 shows a plan view of the car centering device.

Under the roller beds (60) there are two parallel metallic shafts (62) drivingly connected to each other, by means of a lever set (63). The shafts (62) extend axially and each has a series of metallic bars (64) in the shape of perpendicular arms, moving through the grooves located between the roller beds as is shown in FIGS. 8 and 9. These shafts, are driven by an electric gear motor (65) coupled to the end of one of the shafts (62) and transmits the rotary movement to the second shaft through the set of levers (63) reversing the direction of movement, in a way that upon being actuated under the movement of the gear motor, rise from the central part of the car centering device to the external ends, with which will locate the wheels from a side of the cars and will drive them in the same direction until the metallic bars of the other side make contact with the opposite wheels of the car, concluding the centering action. The metallic levers have at the wheel contact end limit switches (not shown) functioning to stop and reverse the rotation movement until the start condition of the centering cycle. The longitudinal shafts upon spinning make contact by means of a cam (not shown) with an articulate lever (not shown) activating or deactivating the brakes on each one of the roller beds. The above shafts are held by a suitable number of journal bearings (67) allowing their rotation. The gear motor (65) is of reversible type, turning through a total angle of 120 degrees in each direction. The spaces around the roller boxes, are suitably covered by non-slip metallic sheet (not shown), to allow vehicle circulation, during access to the parking building.

Through the spaces between the rollers beds, the robot (8) moves from the booth during the car loading and unloading action thereto, thus the dimensions of both devices are adequately proportionate to allow their interaction.

Instrumentation and Control Equipment

The signaling and control system of the parking system forms a basic part thereof since this permits the automatic and safe operation of the entire system.

Figure 10:
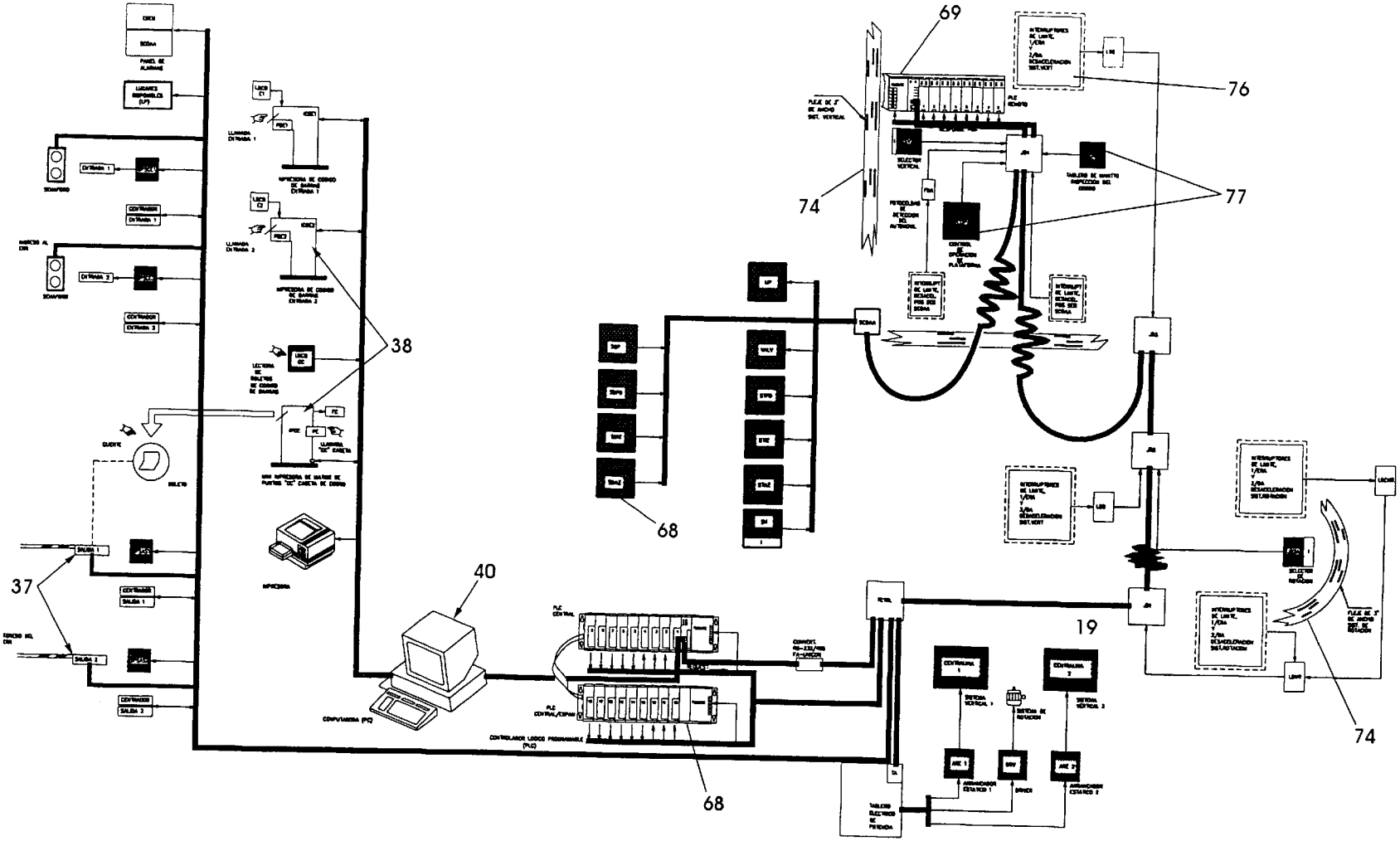
FIG. 10 shows the general configuration of the semiautomatic control system, with logical control programmers.

The basic equipment consists of the following and is related with FIG. 10:

The instrumentation and control system basically consists of four interconnected subsystems integrated between them, to provide the necessary operating and safety conditions, which are:

a) Subsystem for entering, collecting and leaving the parking building.

b) Car centering subsystem.

c) Elevator booth rotation and elevation control system together with security system thereof.

d) Robot loading and unloading subsystem.

Subsystem for Entering, Collecting and Leaving the Parking Building

This subsystem consists of one, two or up to three folding access barriers (37) and conventional ticket dispensing machines (38), which will have car presence sensors which allow the cars to enter when there are spaces available, or refuse entry when the signal of a Logical Control Programmer shows that there are no places available. In another aspect, this system includes the conventional collection system (not shown), which consists of a parking time reader, which issues the collecting cost when the time recorded is multiplied by the unit cost of the time unit. Both items of equipment, that for dispensing tickets and that for reading and invoicing, can be replaced by access and exit equipment which uses magnetic tape or bar code plastic cards to achieve the same effect.

The herein described system is connected to a logical control programmer and a conventional personal-type computer (40) which, in turn, forms part of the elevator operation and call subsystem.

In the case in which the ticket dispenser is of magnetic tape or bar code type, showing date, hour and minute, a card reader will be installed which will calculate the length of stay and the invoicing.

Car Centering Subsystem

This subsystem comprises a logical control programmer (68) and microswitches providing the necessary starting, direction reversing and stop commands of the car centering gear motor (65). The commands are sequence predetermined by the local and remote logical control programmers as well as the personal computer, to obtain and grant the operating sequence permission signals, which are granted through the logical control programming.

Elevator Booth Rotation and Elevation System

This subsystem is integrated by a personal computer, a Local (68) and a Remote (69) Logical Control Programmers as well as the interlink data buses (73) and several magnetic sensors (74) and limit switches acting in a predetermined and sequential way. The personal computer has the purpose to register the entrance of a car to the parking building, to identify the vacant spaces, to select the car destination site according to several embodiments, to carry occupancy registration and to establish time thereof for control and invoicing; as well as receiving car exit request calls, which are sequenced according to a preestablished programming.

The Logical Control Programmer, receives the computer signals and translates them into opening and closing commands of several electric switches to cause stopping, starting and direction reversal of the engines of the car centering device (65), the oil pump engines of the hydraulic power units (19), opening and closing of the fluid control valves, the tower rotation gear motor (42) and the several security mechanisms of the system.

The Remote Logical Programmable Controller is connected to the Local Controller through a RS-232 or RS-485 data bus and serves to issue the commands to the several electric switches (76) for start, stop and direction reversal of the engine for the robot hydraulic pumping engine (33) and the fluid control valves for the hydraulic engine as well as the hydraulic cylinders thereof; also takes into account the signals detected by elevation magnetic sensors (74) located in each floor of the parking building, and the several manual controls (77) for manual operation of the platform operation control, the vertical selector and the inspection maintenance board (77); finally receives the signals from the booth elevation (76) limit switches to establish the systems securities.

Robot Control Subsystem

This subsystem is a complementary part of the Remote Logical Control Programmer (69) of the elevator, which basically consists of run limit switches (75) that sequentially start, stop and reverse the robot oil pump engine (33), closing and opening the hydraulic valves that in sequence provide the desired movements.

Operation Description

Preferred Embodiment

The operation described herein is the one that follows the sequence of entering the parking building, parking the car and, subsequently, leaving the parking building.

Cars coming from any road or avenue, will arrive at the ground floor entrance, which can be one of the parking spaces (two or three), the sole purpose of which is to permit entrance. This one or several parking spaces are equipped with the car centering devices. Since the driver of each car may not have enough skill to park the car in a totally centered form, will leave this task to the car centering device. The car centering device, as above described, comprises an axial metallic bed of rollers that allows the movement of the vehicles transversely, at the time of the cars circulating thereon, said rollers are braked to impede their rotation and with it, the anticipated sliding of the vehicles. Once the driver has parked his/her vehicle on the car centering device, the driver then stops the engine, gets out of the vehicle, locking it and walks to the external column of the parking building, wherein the ticket dispenser is located. The dispenser, is activated by pressing a button, thereby starting in a manual form the automatic operation of the whole sequence of the system.

Next, the elevator call is registered in the personal computer, alloting it a location destination wherein such car must be parked, and depending on several programming embodiments not described in this document. The computer will send signals to the Local Logical Control Programmer which in turn will send the signals to the control board and the power board to activate the car centering device engines, operating in the following way: the gear engine coupled to one of the shafts of the centering device will be started, which upon starting the rotation, will move a lever releasing the brakes acting on the centering device rollers, allowing their rotation by a mechanism. This rotation movement is transmitted to the other shaft which will operate in an opposite direction but with the same purpose; the centering device levers coupled to the shafts will rotate until meeting the uncentered wheels of the cars, driving them and moving transversely the vehicle to the point in which the levers corresponding to the other two wheels of the car reach contact thereto thereby causing a second pair of microswitches to be activated, reversing the rotation of the gear motor, with which the levers will return to their idle start position, reaching thus the centering of the car and again braking the rollers of the beds.

At the same time that the car centering device sequence is started, the local Logical Control Programmer receives the signal from the personal computer and sends the commands to activate the Remote Logical Control Programmer, starting the call sequence of the elevator booth, which will make it move until located in front of the entrance place of the parking building through which a car has been introduced. Only upon completing the car centering sequence, the elevator booth robot will be allowed to proceed out from the elevator booth and take the car. Otherwise, even though the elevator booth was previously located in front of the car centering device, it should wait until the point in which the latter sequence is completed, thus extending the permission to carry out the following operation.

Next, the robot will verify being in its lower position and will proceed to start the hydraulic pumping engine, which will send by means of the necessary fittings and control valves, the hydraulic oil towards the hydraulic engine that will drive the moving beam of the robot, extending it outwards to its final position determined by a run microswitch. The latter upon activation, will instruct the hydraulic control valves to feed the oil to the sliding beam engine and will open simultaneously the oil feeding valve to eight hydraulic cylinders comprised by the robot, which in turn will drive the transverse beam platform carrying the car by its four tires, to hoist it into position wherein they do not rest on the roller bed, but on the robot bars. Upon completion of the hoisting operation the hydraulic control valves of the cylinders will close and open the control valves for the hydraulic engine of the sliding beam of the robot, but in an opposite direction causing the sliding beam to displace together with the car, towards the inside of the elevator booth, wherein at the end of the run another position microswitch will be operated. With the above the Logical Control Programmer grants the permission to the elevator to start its operation.

Once the Logical Control Programmer knows which is the origin and destination of a determined car, the start commands will be given for the two pumping engines pertaining to the hydraulic power units of the elevator, and simultaneously to the elevator turning gear engine of the system. Both rotation and elevation actions if necessary, are carried out simultaneously. The tuning of the hydraulic pumping engines of the hydraulic power units, will cause that by opening the hydraulic control valves, oil will flow simultaneously to the two hydraulic cylinders of the elevator, moving vertically their pistons, making the pulleys ascend vertically and the metallic cables to be moved, which on one side are connected to the elevator tower and on the other to the elevator booth. The booth will be raised while counting the magnetic pulses sent by the vertical control of the elevator, to the point in which the Logical Control Programmer, will send the high flow valve closing command, of the hydraulic power units, which will reduce the speed of displacement of the booth in about a fourth of the normal speed of operation. When the booth has reached its vertically destination position, the magnetic sensors will send signals to the remote Logical Control Programmer, which in turn will command the second oil control valves to close, thus stopping its supply to the cylinders and the elevator will stop. In such a case that a vertical re-leveling of the elevator booth should be necessary, the minimum oil control valves will reopen to allow the elevator booth to rise or lower just a small distance.

Simultaneously, the elevator tower, if necessary, will turn by the action of the gear engine receiving the signals coming from the personal computer and from the Local Logical Control Programmer, making it rotate in one direction or the other, which through the action of the pinion gear will make the crown to be displaced moving the elevator tower as a whole. In a similar fashion, the turning distance will be transported to the elevator causing the gear engine to stop in the indicated position and reaching an angular re-leveling in case of need, so that the elevator booth stays in its exact position with respect to its programmed destination.

Once the elevator booth is located in its destination position, the permission to start the unloading operation of the car outward from the booth and its location in the parking places of the parking building will be initiated. Next, the robot pumping engine will be started, sending the oil to the robot hydraulic engine, which will move the sliding beam to its maximum run position activating the run end microswitch, which will instruct closing the oil flow valve and opening the oil control valve of the robot cylinders, causing them to retract, thus lowering the robot bar table, placing the cars wheels in the parking place trays, lowering the robot to its bottom position and activating in turn another microswitch that will close the control valves of the pistons and will open the hydraulic control valve of the hydraulic engine, this making it turn in the opposite direction until the robot moves inwards inside the elevator booth, thus ending the total car loading cycle.

For the exit of a car from the parking building, the operation will be carried out in a similar way but with some of the sequences reversed, which will take the car to the exit of the parking building, where the driver will take it. The exit operation is automatically programmed, when in the exit control board a vehicle is requested to leave the parking building.

Both the entrance and exit commands, will be registered in an operating sequence that the personal computer handles automatically.

What is claimed is:

1. A robotized car parking system comprising:

a parking building having at least two levels and a vertical opening extending to each level, a vertical tower rotatably supported within said vertical opening for rotation about a vertical axis, an elevator booth supported within said tower for vertical movement between said levels, guide means for guiding vertical movement of the elevator booth in said tower, driving means for moving the elevator booth vertically in said tower, turning means for turning said tower and said elevator booth therein around said vertical axis, a robot in said elevator booth including a mechanism for extending and retracting said robot from and into said elevator booth to engage a vehicle outside said booth and transport the vehicle into said booth and transport the vehicle from within the booth to outside the booth, and a centering device located on an entry level of said building at a location adjacent to said elevator booth for centering a vehicle to a position in which the vehicle can be engaged by said robot and transported into said elevator booth, at least one level of the building being divided into a number of parking spaces arranged radially around said tower so that said robot can transfer a plurality of vehicles to and from said parking spaces by radial displacement of said vehicles into and from respective parking spaces.

2. The robotized car parking system according to claim 1, wherein said driving means for moving the elevator booth vertically comprises a hydraulic system with pulleys, cables and counterweights.

3. The robotized car parking system according to claim 2, wherein said pulleys include a first set of pulleys fixed to the elevator booth and a second set of pulleys supported by said tower for vertical movement relative to said tower, said cables passing on said pulleys and being fixed at one of the ends of the cables to said elevator booth and at opposite ends thereof to said counterweights, said hydraulic system including a hydraulic cylinder with a piston connected to a respective one of said counterweights to move the counterweight and an associated one of said movable pulleys vertically to raise and lower the elevator booth.

4. The robotized car parking system according to claim 1, wherein said building is substantially cylindrical.

5. The robotized car parking system according to claim 4, wherein said building has a foundation with a well beneath said vertical opening into which said tower extends and is rotatably supported, said foundation including a horizontal slab extending beyond said tower, said building including external support columns on said slab, internal columns and radially extending girders connecting said internal columns to said external columns, said internal girders being arranged around said vertical opening.

6. The robotized car parking system according to claim 5, wherein said driving means is disposed in said well.

7. The robotized car parking system according to claim 1, wherein said elevator booth comprises a platform of metallic sheeting in parallelepiped form, reinforced by a plurality of structural elements constituting a frame, said guide means including guides on said booth which engage corresponding guide rails on said tower.

8. The robotized car parking system according to claim 1, wherein said robot comprises a central tubular beam which is provided with grooves containing a series of bearing wheels that allow the beam to be moved outwardly from the both, in a little less than a total length of the beam; reversible displacement of the beam back into the booth being effected to retract the robot; two sets of comb-shaped transverse metallic bars arranged on said beam to raise and lower a vehicle thereon, two of said transverse bars being spaced for holding front wheels of the vehicles, and being separated a distance to allow said front wheels to be trapped therebetween, a plurality of said transverse bars being provided for holding rear wheels of vehicles of different length and width.

9. The robotized car parking system according to claim 1, wherein said centering device comprises a right bed of metallic rollers and a left bed of metallic rollers for laterally displacing a vehicle supported on said rollers.

10. The robotized car parking system according to claim 9, wherein said roller beds are provided with a braking system to prevent rotation of said rollers when the vehicles are supported thereon; two parallel metallic shafts extending under the roller beds and connected by a lever, each shaft having a series of metallic bars in the shape of perpendicular arms, movable through grooves located between the roller beds; said shafts, being movable by an electric gear motor coupled to an end of one of the shafts and connected to transmit rotary drive movement from said one shaft to the second shaft through a set of levers reversing the direction of movement, such that under the drive of the gear motor, the shafts move from a central part of the centering device to opposite ends, and locate the wheels on one side of the vehicle and drive it in the same direction until the metallic levers at the other side make contact with the opposite wheels of the vehicle, the metallic levers being provided, at wheel contact ends thereof, with limit switches for stopping and reversing the rotation to return the centering device to its original position in preparation for a subsequent centering operation.

11. The robotized car parking system according to claim 1, comprising entry and exit means for vehicles into and out of the building and a logical control programmer for operating said entry and exit means based on availability of parking spaces in said building.

12. The robotized car parking system according to claim 1, wherein said driving means, said turning means, said robot and said centering device are connected to a personal computer, local and remote logical control programmers, interlink data buses and several magnetic sensors and limit switches operative in a predetermined and sequential manner; the personal computer registering entry of a vehicle into the building, identifying vacant spaces, selecting a destination space for the vehicle, recording occupancy, registration and establishing occupancy time of the vehicle for control and invoicing, and receiving vehicle exit request calls, which are sequenced according to a preestablished program, the logical control programmers, receiving the computer signals and converting said signals into opening and closing commands of the electric switches to cause stopping, starting and direction reversal of the centering device, the hydraulic power units, opening and closing of fluid control valves, rotation of the tower and security mechanisms of the system; a remote logical programmable controller being connected to the local controller through a data bus to issue commands to the electric switches for start, stop and direction reversal of the robot and fluid control valves for the hydraulic cylinders including receiving signals detected by elevation magnetic sensors located at each level of the building, and manual controls for manual operation of a platform control, a vertical selector and an inspection maintenance board; and finally receives signals from booth elevation limit switches to establish system security.

13. The robotized car parking system according to claim 1, wherein said building is modular and made of steel so that the number of levels can be increased to increase vehicle capacity.

14. The robotized car parking system according to claim 1, wherein said building has at least two vertical openings with respective said towers and elevator booths therein.

* * * * *